United States Patent [19]

Coogan

[11] Patent Number: 5,056,667

[45] Date of Patent: Oct. 15, 1991

[54] COLLAPSIBLE PALLET CAGE

[75] Inventor: James D. Coogan, Plympton North, Australia

[73] Assignee: Rees Operations Pty. Ltd., Plympton, Australia

[21] Appl. No.: 458,760

[22] PCT Filed: May 16, 1989

[86] PCT No.: PCT/AU89/00211

§ 371 Date: Jan. 17, 1990

§ 102(e) Date: Jan. 17, 1990

[87] PCT Pub. No.: WO89/11422

PCT Pub. Date: Nov. 30, 1989

[30] Foreign Application Priority Data

May 17, 1988 [AU] Australia ..... Pi8267

[51] Int. Cl.[5] ..... B65B 19/06

[52] U.S. Cl. ..... 206/600; 220/7

[58] Field of Search ..... 206/600, 386; 220/6, 220/7, 4.29

[56] References Cited

U.S. PATENT DOCUMENTS

| | | | |
|---|---|---|---|
| 3,542,234 | 11/1970 | Bonomi | 220/7 |
| 4,221,296 | 9/1980 | Fell et al. | 206/600 |
| 4,339,047 | 7/1982 | Johansson et al. | 220/7 X |
| 4,662,532 | 5/1989 | Anderson et al. | 220/7 |
| 4,735,330 | 4/1988 | Hoss | 220/7 |
| 4,735,331 | 4/1988 | Keenan et al. | 220/7 X |
| 4,817,824 | 4/1989 | La Fleur et al. | 206/600 X |

FOREIGN PATENT DOCUMENTS

| | | | |
|---|---|---|---|
| 255323 | 9/1962 | Australia . | |
| 434580 | 1/1969 | Australia . | |
| 4645768 | 5/1970 | Australia . | |
| 457752 | 12/1971 | Australia . | |
| 1744870 | 1/1972 | Australia . | |
| 2105683 | 3/1983 | United Kingdom | 206/600 |
| 2123789 | 2/1984 | United Kingdom | 206/600 |

OTHER PUBLICATIONS

Australian Patent Abstract (Crypal Pyt. Ltd.), 81097/82, 9/9/82.

*Primary Examiner*—Paul T. Sewell
*Assistant Examiner*—Jacob K. Ackur, Jr.
*Attorney, Agent, or Firm*—Darby & Darby

[57] ABSTRACT

A collapsible storage container has a rectangular support base with a horizontal floor and upwardly projecting skirting walls, each wall being a different height above the floor, a pair of end wall panels, a pair of side wall panels, and a lid panel. Each of the wall panels is pivotably supported for inward folding movement about a horizontal axis with the horizontal axes of the wall panels being spaced at different distances from the floor, cooresponding to the height of the associated skirting wall. The panels can be folded approximately flat, one on top of the other in overlying relationship. A spring loaded latching mechanism locks adjacent panels together near their upper adjacent corners.

19 Claims, 7 Drawing Sheets

COLLAPSIBLE PALLET CAGE

This invention relates to an improved collapsible or folding container for the storage of goods, and is particularly concerned with an improved collapsible pallet cage of the type having a pallet base, a pair of opposed end panels hinged with respect to the base for folding inwardly thereonto, a pair of opposed side panels hinged also with respect to the base for folding inwardly thereonto, and a lid or top panel arranged to be supported on the upper edges of said side and end panels when the cage is erected so as to close off the top end of the pallet cage, the cage (or container), when in an erected position, being of substantially parallelepiped box shaped form, whilst when in its collapsed position, the side and end panels lie in a flat condition on top of the pallet base with the top or lid panel disposed above or on top of the end panel remote from the pallet base.

Collapsible storage containers comprising a front, rear and side wall panels which are either permanently or releasably hinged to the pallet base so that they fold down to a collapsed condition or can be removed from the pallet base and stacked for transport of the container in a folded down condition, are of course well known. Generally, it is considered undesirable for the side and end wall panels to be removably hinged to the pallet base and the need has existed for a collapsible pallet container which enables the side and end wall panels to be simply and quickly folded between their collapsed and erected positions-without, for example, having to individually bodily lift the panels prior to or during the folding of same—refer Australian Patent Specification No. 49913/72. It will be appreciated that, in certain cases, the weight of the panels can be quite considerable to the extent that the collapsing and erecting of prior pallet cannot be carried out by a single person—or if so, certainly without considerable physical strain being exerted.

A further problem with known pallet containers stems from the manner in which the panels are fastened when in their erected condition. For example, many employ "loose" removable components or items such as bolts/nuts, latches and/or clips which can be readily lost and which require the use of a spanner or similar tool in order to disengage or remove same (when the container is being collapsed for example).

A still further problem is that the prior art latch arrangements are prone to disengage easily, for example during transport of the container, and generally do not impart sufficient rigidity to the erected structure. A still further problem is that the latches and clips are often located so that they project into the interior of the erected container and hence there is a likelihood of the goods or products stored in the container being damaged.

A still further disadvantage with prior art collapsible containers/cages is that they cannot be readily and easily accessed when the container is in its erected condition and packed with goods or products, or for example when the containers are stacked one on top of the other when in their loaded condition. In some cases, the lid or top panel of the container needs to be lifted initially prior to being able to fold down the front panel or gate. Consequently with containers in a stacked condition, it has not been possible to gain access (for the purpose of inspection), to the interior of a loaded container when another container is stacked on top thereof.

Furthermore, even with the container standing alone, it has not been possible to access the interior of the container without having to lift the lid or top panel before being able to fold down the front panel or gate.

It is the main object of the present invention to provide an improved collapsible storage container which is of very simple design construction, may be constructed to any size, and which allows the side and end wall panels thereof to be simply and quickly folded between their collapsed and erected positions without any significant physical effort.

It is a further object of the present invention to provide an improved collapsible storage container which is able to be readily collapsed to its transport condition without the use of tools such as spanners and the need to remove bolt/nut assemblies or any other similar "loose" fasteners or connectors from the panels. It is a further object of the present invention to provide an improved collapsible storage container which is able to be simply and quickly accessed, for example for the purpose of inspecting the goods stored therein, without lifting its top or lid panel, whether standing alone or with other similar container stacked on top thereof.

It is a still further object of the present invention to provide an improved collapsible container wherein the adjacent wall panels can be conveniently locked together when in their erected condition by means of a latching mechanism which is unlikely to disengage during use, does not project or protrude into the interior of the erected container, and which is designed so that it is unlikely to be damaged when the container is in its folded down or collapsed condition.

It is yet a further object of the present invention to provide an improved collapsible container wherein the pallet base, the wall panels and the top or lid panel are assembled as an "integral" system both in the erected and collapsed conditions.

In one aspect of this invention therefore, an improved collapsible storage container comprising a substantially rectangular support base having an horizontal floor, a pair of opposed end panels (one of which constitutes the front panel, the other constituting the rear panel of the container) hinged about respective horizontal axes for folding inwardly relative to the base into a collapsed condition, and a pair of opposed side panels are hinged about respective horizontal axes for folding inwardly relative to the base into a collapsed condition, said horizontal axes being spaced at different distances from the floor so that the panels can be folded inwardly approximately flat one on top of the other with adjacent panels in overlying relationship, the improvements comprising;

a stub corner post of angle section fixed vertically at each of the four corners of the base with the limbs thereof engaging respective vertical wall portions of the support base, each said corner post having a height such that when said panels are in their collapsed condition, the upper ends of the corner posts project above the level of the uppermost rolded down horizontal panel, at least three upwardly projecting skirting walls on the base each extending between a respective pair of said stub corner posts and each being a different height above the floor, each said skirting wall having a horizontal upper edge surface on which is supported a respective said panel, when in its erected condition, each said panel being pivotally supported between a respective pair of said corner posts by pivot means comprising substantially non-load bearing pivot pins projecting laterally from opposite sides of the panel adjacent its lower end, each said projecting pin engaging in a hole formed in a limb of a respective said corner post (or in a respective said skirting wall).

Preferably the front panel or gate, when in its erected condition, is arranged to have its bottom or lower edge contiguous with the floor of the support base along one side thereof, with the three remaining panels resting on the upper edges of peripheral walls extending along the remaining three sides of the base. With this arrangement, the container is collapsed by firstly folding the front panel inwardly so as to overlie approximately the whole of the floor of the base, and subsequently folding inwardly the side wall panels so as to lie on top of one another on top of the folded-down front panel, and finally folding down the rear wall panel so as to lie on top of the folded down side panels. With this invention, the container is able to be folded down into a neat flat package for stowage.

Preferably, the container comprises a lid or top panel which may be removably supported on the upper edges of the side and end panels, when the container is erected or may be hingedly supported by the rear panel at or adjacent its upper edge so that it can be swung outboard between a fully open position where it lies approximately parallel with the outer face of the rear panel and a closed position where it is supported on the upper edges of the side and end panels.

Preferably, the lid or top panel comprises a pair of panel portions hingedly connected to one another and arranged to permit the panel portions to lie one on top of the other (when the lid is in a folded partly open condition) or to lie coplanar with one another (when the lid is in its in-use condition).

In another preferred form of this invention, the front panel or gate is formed in two halves which are hinged together by hinge means to enable each of the halves to swing about an horizontal axis relative to the other half. The bottom half of the front panel is pivotally connected by a pair of laterally projecting horizontally aligned slidable pivot pins or bolts to respective stub corner posts whereby the front panel as a whole is able to swing or fold inwardly so as to lie flat on top of the base floor or outwardly so as to extend away from the support base. The upper half of the front panel is also provided with a pair of slidable pivot bolts, one at each side thereof which are arranged to releasably engage in pivot bolt engaging apertures in peripheral frame members of adjacent side wall panels whereby with the pivot bolts so engaged (and the lower pivot bolts disengaged), the lower half of the front panel is able to be independently swung upwardly and outwardly so as to provide an access opening into the bottom half of the interior of the container.

In yet another preferred aspect of the present invention, there is provided an improved latching mechanism for releasably latching together adjacent panels at the upper corners of the container, when in an erected condition, the latching mechanism comprising an externally mounted spring-loaded pivoted lever arm supported by one said panel adjacent an upper corner thereof on a pivot spaced from the arm intermediate its ends and extending at right angles to the plane of the panel on which it is carried, the lever arm carrying at its upper end a latch pin extending at right angles to the lever arm and extending in a direction parallel to the plane of said panel, the latch pin being arranged to engage through a hole or aperture formed in the end of an external latch engaging bar slidably mounted at the upper corner of an adjacent panel for sliding to and fro movement in a direction at right angles to the axis of the latch pin, the pivotal movement of the lever arm permitting the latch pin to be selectively engaged or disengaged with the latch engaging bar. The latch engaging bar when in the latch engaging position, extends through aligned slotted openings formed in the peripheral frame members adjacent their upper corners of the adjacent panels being latched together.

Preferably, further latching means are provided for releasably latching together the top or lid panel to at least one of the end or side panels - the latching means being substantially identical to the latching mechanism previously described.

To enable the containers to be stacked one on top of the other, the lid or roof panel has recessed portions at each of its four corners, each of the recessed portions being arranged to seatingly engage a corresponding corner portion of the pallet base of an adjacent container. The hinge mechanisms located on the lid or roof panel are housed within the confines of the panel so that there is no interference when the containers are stacked one on top of the other.

In another preferred arrangement, the removable lid or top panel is provided with a depending peripheral flange, and is shaped and dimensioned so that when the container is in a collapsed condition, with the side and end panels folded down, the lid or top panel can be horizontally supported at each of its corners on top of the stub corner posts. The container when collapsed, thereby assumes a flat neat package, enabling another collapsed container to be stowed on top thereof.

In order to more fully explain the present invention several embodiments are described hereunder in some further detail with reference to the accompanying drawings in which.

Figure 1:
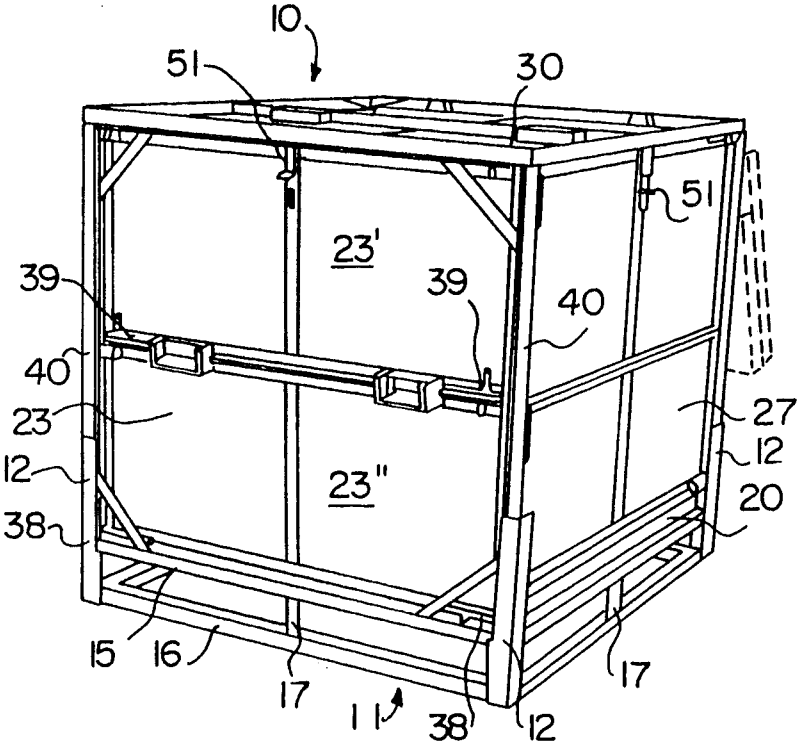
FIG. 1 is a perspective view of a storage pallet container (with the lid shown in dotted lines in its open position) according to one embodiment.
Figure 4:
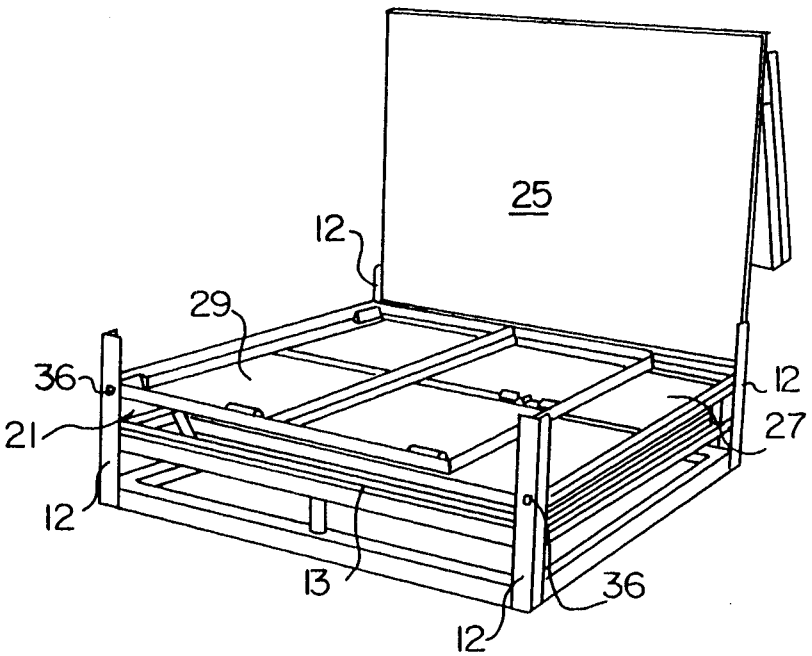
FIGS. 3 to 5 are perspective views of the container in progressively folded down conditions, with FIG. 5 showing the container fully collapsed with the lid panel folded on top thereof.
Figure 2:
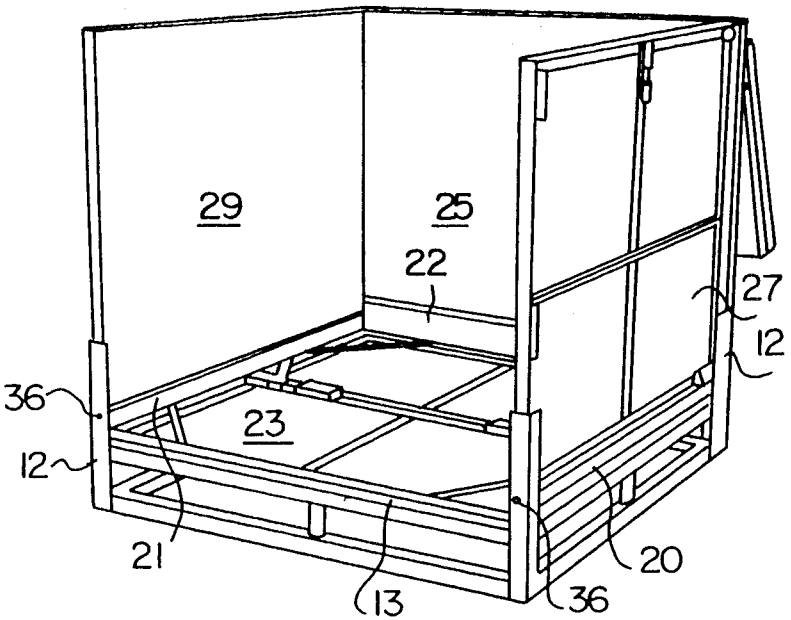
FIG. 2 is a similar perspective view of the container showing the front panel folded down and the lid open.
Figure 5:
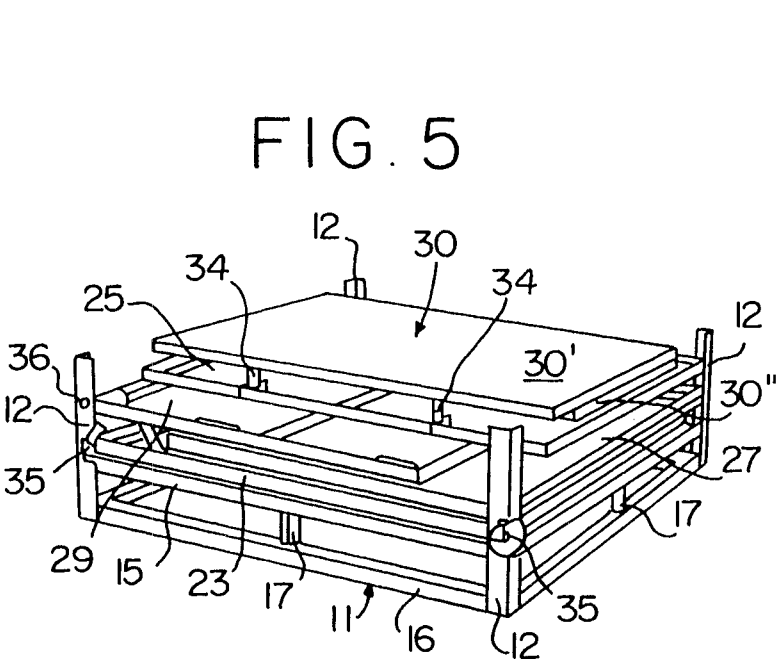
Figure 3:
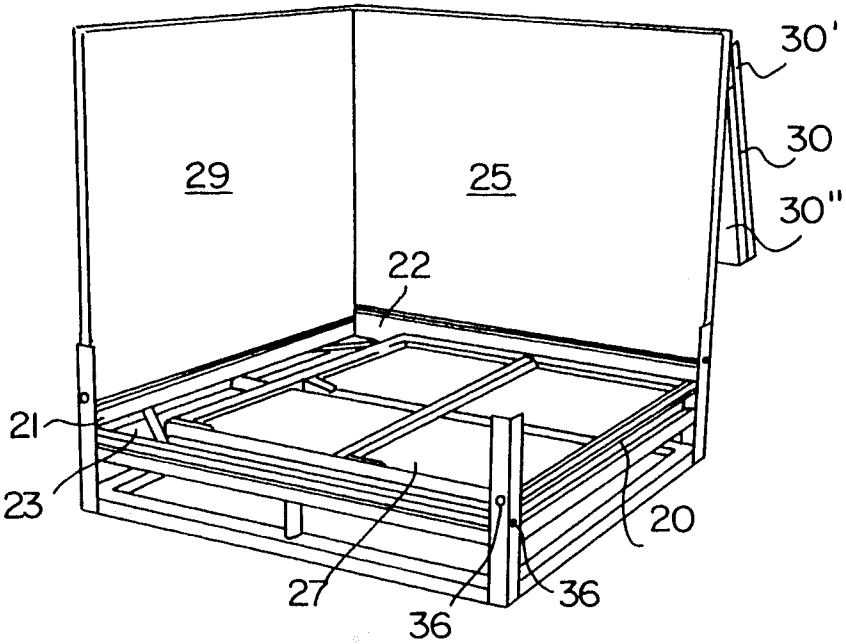
Figure 6:
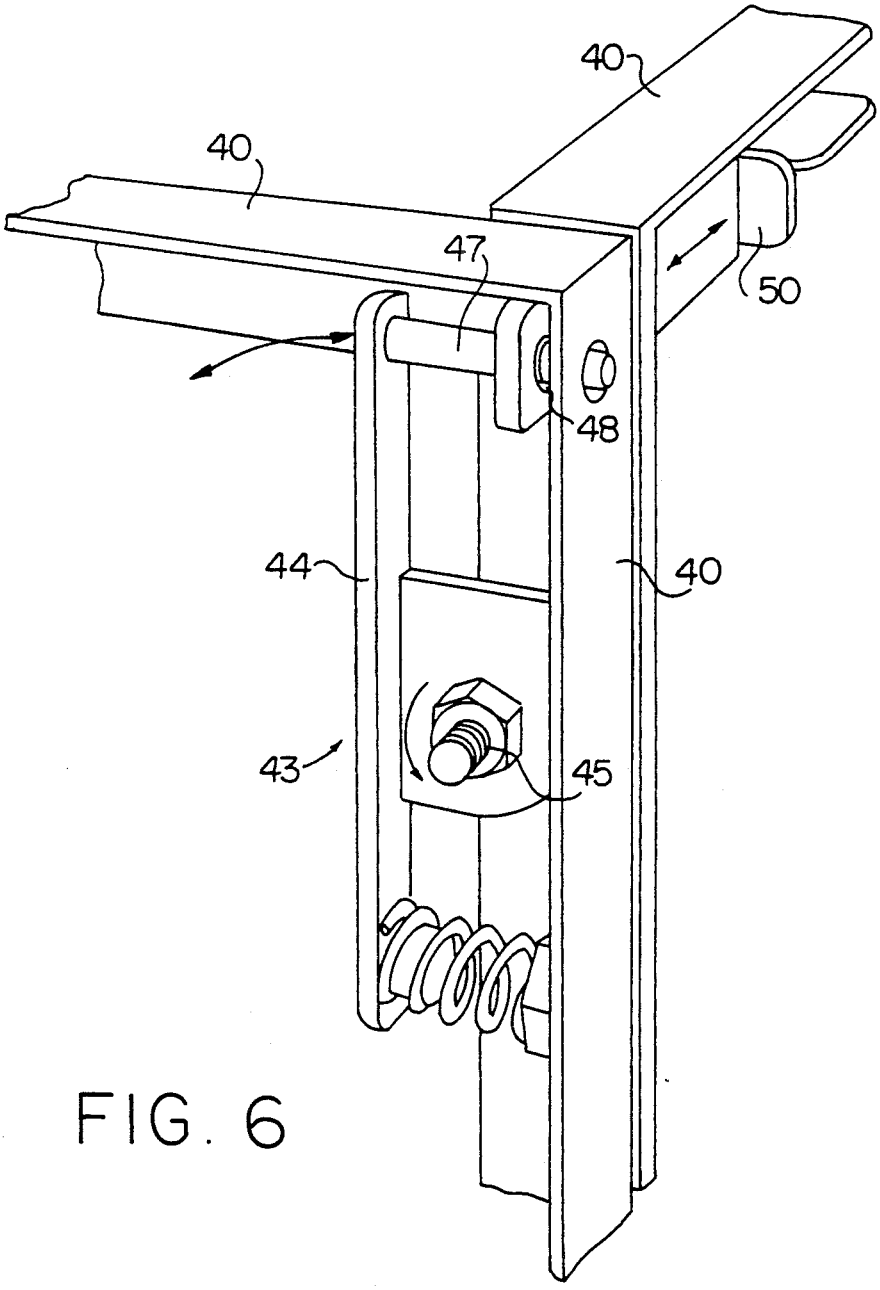
FIG. 6 is a fragmentary perspective view of the corner latching mechanism between adjacent panels.
Figure 8:
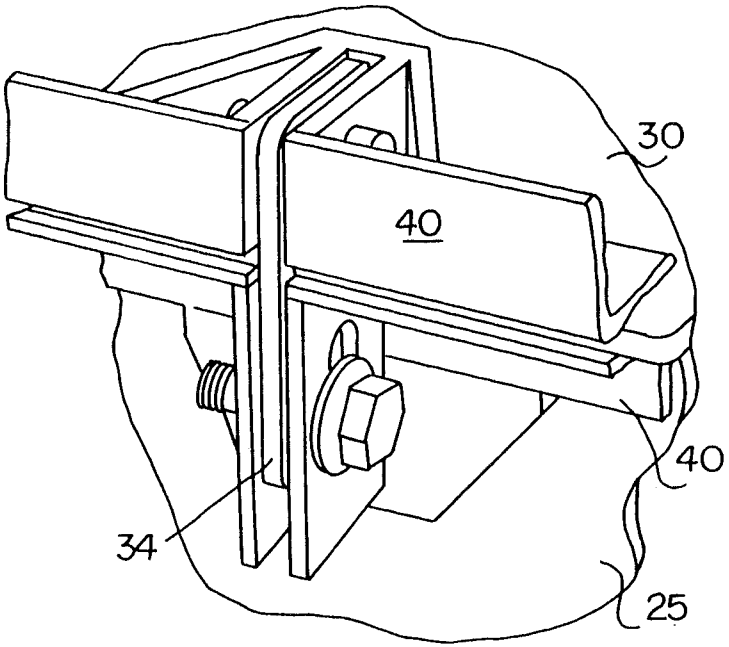
FIG. 8 is a fragmentary perspective view of the hinge between the lid panel and the rear panel.
Figure 7:
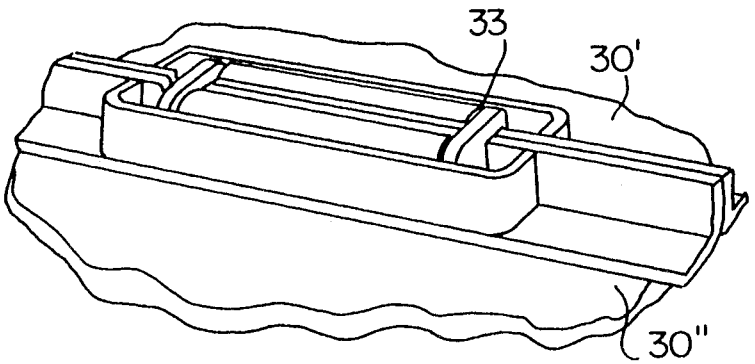
FIG. 7 is a fragmentary perspective view of the double hinge mechanism used to hinge together the panel halves of the front panel and lid panel.

In the embodiment illustrated in FIGS. 1 to 8, there is shown a storage pallet container/cage 10 having a rectangular pallet base 11 which is provided at each of its four corners with stub corner posts 12 of angle section, the pallet base 11 having an horizontal timber floor supported by an upper deck 15 which in turn is supported by a lower deck 16 by short length vertical uprights 17, in addition to the stub corner posts 12. The pallet base 11 is also provided with three upwardly projecting peripheral wall or skirting members 20, 21, 22 extending along both sides and the rear of the base 11, respectively the height of the two side wall members 20, 2 being different to each other and being slightly lower than that of the rear wall member 22. In this embodiment, the front of the pallet base 11 is left open (without a wall member), whereby the upper edges of the front, rear and sides of the pallet are spaced at different distances from the pallet floor 13.

The pallet container 10 is provided with a pair of folding end panels, 23, 25 (panel 23 constituting the front panel or gate, panel 25 constituting the rear panel or gate) and a pair of folding side panels, 27, 29 each of the panels 23, 25, 27, 29 comprising a peripheral metal frame of angle section frame members 40 to which are secured a solid timber ply panel located on the inside of the angle metal frame members. In this embodiment each of the side panels 27, 29 and rear panel 25 is a one-piece panel whilst the front panel or gate 23 is divided horizontally into two halves 23', 23" which are hinged together to permit the two halves 23', 23" to hinge relative to one another. A top or lid panel 30 is hingedly connected to the rear panel 25 and which, when in its closed position, is supported on the top edges of the vertical side and end panels so as to close off the open upper end of the container 10, the top or lid panel 30 also being formed in two panel sections 30', 30", hinged together by hinge means 33 (refer FIG. 7) which permits panel section 30" to be hinged back so as to lie flat on top of the other panel section 30' so that in turn the two panel sections 30', 30" can then be bodily swung outwardly away from or outboard of the container 10 so that they are suspended from the hinges 34 which connect the top or lid panel 30 to the upper edge of the rear panel 25, whereupon the upper end of the container 10 is fully open.

Each of the panels 23, 25, 27, 29 is hingedly connected with respect to the pallet base 11 by means of a pair of laterally projecting, horizontally aligned pivot pins or bolts 35 which engage in apertures 36 formed in the corner posts 12, each of the side panels 27, 29 being hingedly mounted for inward swinging movement about an axis which is at right angles to the pivot axis of the hinge connection for the end panels 23, 25, the hinge axis for the front panel 23 being slightly below the hinge axis of the side panel 27 which in turn is slightly below the hinge axis for the side panel 29, which also in turn is slightly below the hinge axis for the rear panel 25. The panels are arranged so that the front panel 23 can be firstly folded inwardly so as to lie flat on the floor 13 of the pallet base 11 (over approximately the whole of its area) followed by the side panel 27 so as to lie approximately flat on top of the folded down front panel 23, then the side panel 29, followed finally by the rear panel 25, together with its attached top or lid panel 30, the rear panel 25 being folded inwardly so as to lie approximately flat on top of the side panel 29, with the top or lid panel 30 being supported on top of the rear panel 25 with its two panel sections 30', 30" folded on top of one another.

With the side panels 27, 29 and rear panel 25 in their erected positions, their bottom edges or edge surfaces rest on or are contiguous with the upper edge surfaces of the corresponding wall members 20, 21, 22 whereby any load applied to the panels 27, 29, 25 is transmitted directly to the base 11 via the wall members and virtually no weight is carried by the pivot pins or bolts 35 of the panels. The front panel 23, when erect, has its lower edge resting on the floor 13 of the base 11, but it will be realised that it too may be supported on a fourth peripheral wall member having a height different to the other three.

In this embodiment, each of the panel halves 23', 23" of the front panel 23 is provided with releasably engageable hinge connections 38, 39 to permit either panel half to be swung outwardly relative to the other panel half or to permit the panel as a whole to be folded inwardly as described hereinabove. The hinge connection 38 for the lower panel half 23" comprises a pair of horizontally aligned slidable hinge bolts or pins, each of which is arranged to slidably engage in an aligned recess or hole formed in a respective stub corner post 12, whilst the hinge connection 39 for the upper panel half 23' similarly comprises a pair of horizontally aligned slidable hinge bolts at the lower corners thereof, each of which is arranged to releasably engage in a hole or recess formed in the metal frame member 40 of an adjacent side wall panel 27, 29. With this arrangement, the interior of the pallet container can be readily accessed either through the upper or lower panel half of the front gate 23 (depending upon whether the upper half or lower half of the container interior is required to be inspected). In addition, this arrangement permits the container to be used as a grain hopper, for example, by opening the lower half 23" of the front gate 23. The inspection feature is of course an advantage when containers are stacked one on top of the other, namely where one cannot open the lid panel to inspect the container interior.

Each upper corner of the pallet container 10 (when in its erected condition) has a panel fastening or latching mechanism 43 (refer FIG. 6) to secure together adjacent pairs of panels so that the whole assembly is held securely in its erected condition. Each latching mechanism 43 comprises a vertically mounted pivoted rocking lever arm 44 rockingly supported on a pivot 45 spaced a short distance from the arm and which extends in a direction at right angles to the plane of the panel on which it is carried, the pivot 45, in this embodiment, being supported by one of the peripheral angle frame members 40 of the panel. The lever arm 44 is provided with a latch pin 47 which projects at right angles to the arm 44, the pin 47 being arranged to engage through an aperture 48 formed adjacent the end of a slidable latch engaging bar 50 which is carried adjacent the upper corner of an adjacent panel, the latch engaging bar 50 being arranged to slide through slotted openings (not shown) formed in the frame members 40 of the adjacent panels. In this embodiment the lever arm 44 is spring loaded—being biased towards its engaged position. The component parts of the latching mechanism 43 are designed so that their outer surfaces do not project outwardly beyond the outer edges of the angle metal peripheral angle frame members 40 of the wall panels. This minimises any likelihood of damage to the latching mechanism, particularly when the containers are being transported and also minimises the likelihood of the latching mechanisms being accidentally disengaged.

Additional latching mechanisms 51 are provided between the top or lid panel 30 and the side and end wall panel 23 to ensure that the top panel 30 is firmly secured in its closed position during transportation of the container 10. Each latch mechanism 51 comprises a slidable bar releasably engaging in an aperture in the frame member of the lid panel 30.

The connections made by the latch mechanisms 43, 51 impart significant rigidity to the container, and of course, with the latch mechanisms located on the exterior walls of the container, the interior of the container is completely smooth and there is thus no likelihood of any damage being done to the goods stored therein.

It will be realised that the front panel or gate 23 of the container 10 can be folded or hinged outwardly (as a whole) by simply disengaging the latching mechanism 43, 51 and also the hinge or pivot bolts 39 on the upper half 23' of the front panel 23, whereafter the panel 23 as a whole can be swung outwardly to completely open the front of the container without having, for example, to lift the lid or cover panel 30 (as is normally the case with prior art containers).

Figure 9:
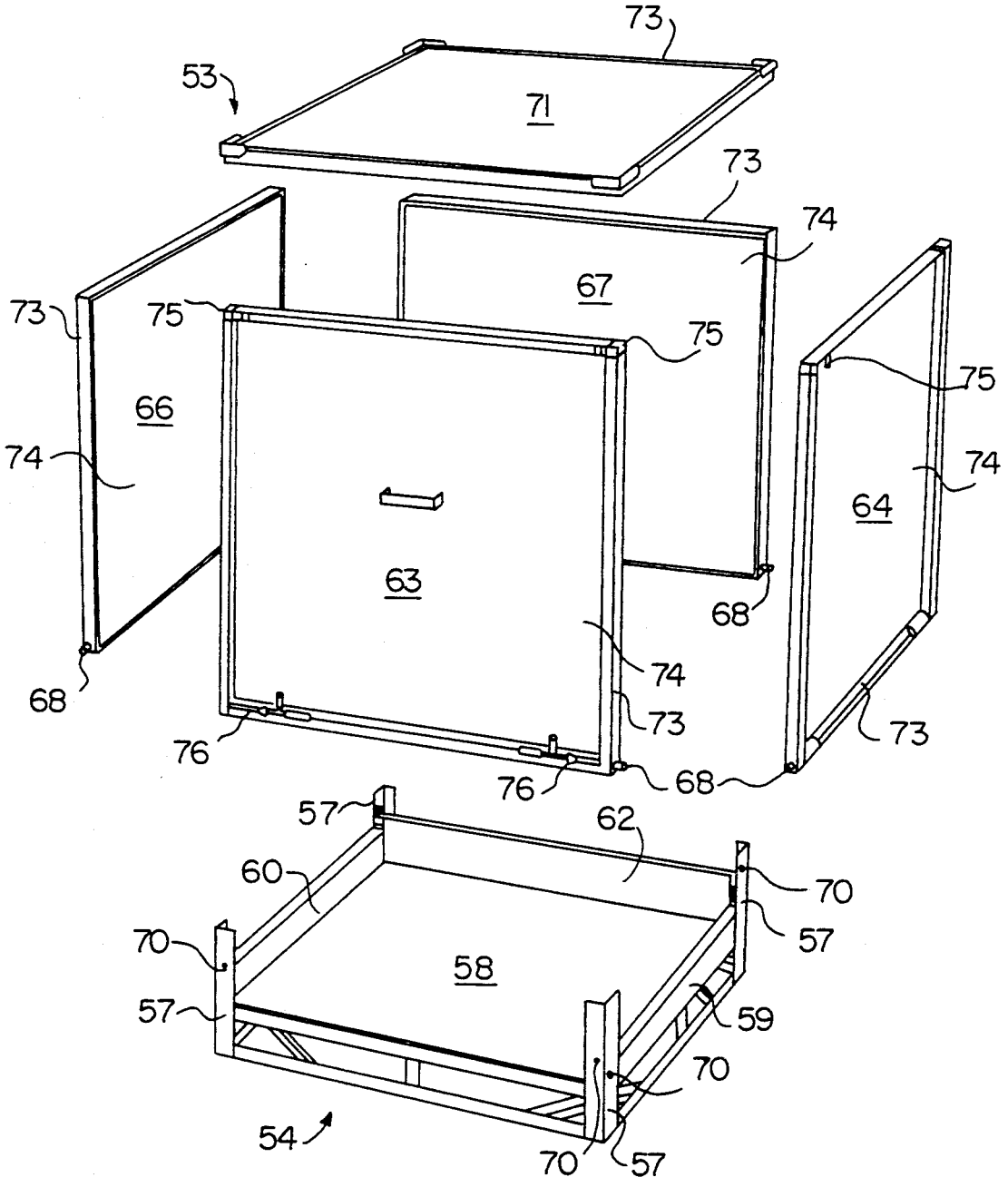
FIG. 9 is an exploded perspective view of a pallet container according to a second embodiment.
Figure 10:
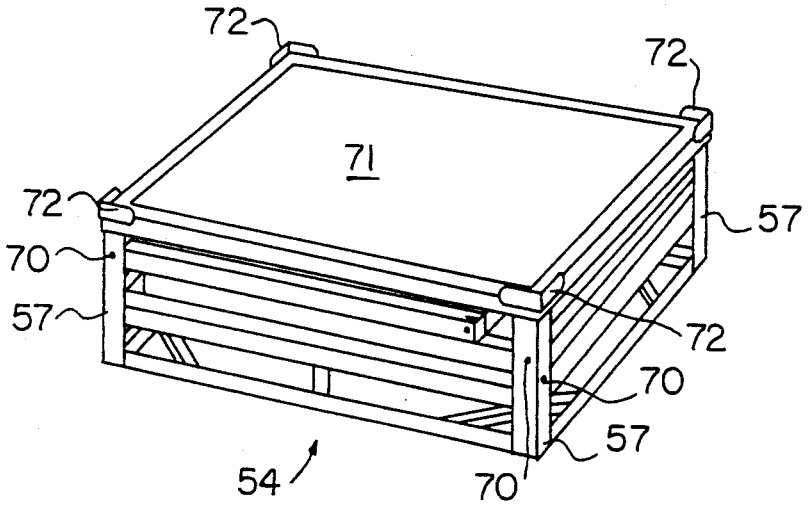
FIG. 10 is a perspective view of the container fully collapsed.
Figure 11:
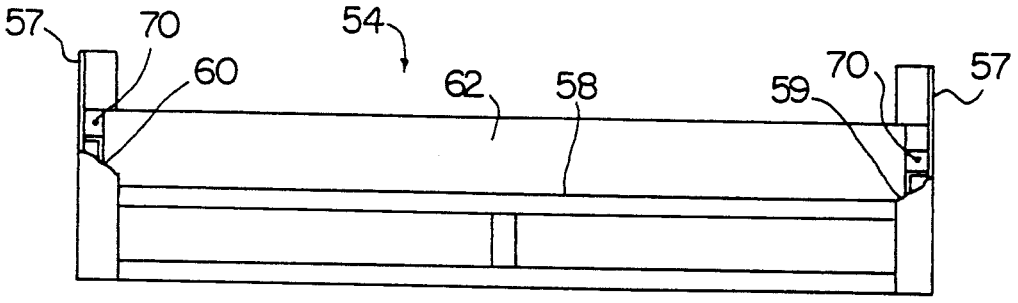
FIG. 11 is a front elevational view of the pallet base only.

Turning to the embodiment illustrated in FIGS. 9 to 11, there is shown a storage pallet container 53 having a rectangular pallet base 54 which is provided at each of its four corners with stub corner posts 57 of angle section, the base 54 having a horizontal load supporting floor 58 supported by upper and lower decks identical to that previously described.

The base 54 is also provided with three upstanding peripheral wall members 59, 60, 62 extending between respective pairs of corner posts 57 and along both sides and the rear of the base 54. The height (i.e. distance from the floor 58) of wall member 59 is less than that of wall member 60 which in turn is less than wall member 62.

The container 53 is provided with hinged wall panels, namely a front panel 63 which, when erect, rests on the floor 58. side panels 64. 66 which rest on members 59, 60 respectively, and a rear panel 67 which is supported on member 62, whereby the panels are supported by the base 54 on different horizontal planes containing the floor 58 and the upper edge surfaces of the members 59, 60, 62.

Each of the panels 63, 64, 66 and 67 is pivotally connected to the base 54 by a pair of laterally projecting, horizontally aligned pivot pins 68 welded to the panel frame and which are journalled in holes 70 formed in the corner posts 57 (or the members 59, 60, 62) the panels being mounted for inward swinging movement about horizontal axes which are contained in different horizontal planes. The panels when folded-down lie flat on top of one another with adjacent panels being in overlying relationship. The order in which the panels are folded down is the same as described for the container of the first embodiment.

The height of the corner posts 57 is selected so that all four side and end panels, when folded down, are stored within the confines of the base 54 and assume a "stacked" height which is less than the corner post height (i.e. the corner post height above the base floor 58 will be greater than 4 times the thickness of the panels). The lid panel 71, in this embodiment, is removable and being of tray-like construction, is able to be supported, when the container is collapsed, at its four corners by the upper ends of the corner posts 57 (refer FIG. 10). When collapsed, the container 53 thus forms a relatively flat, neat package. Corner angle members 72 fixed to the corners of the lid 72 and projecting from the upper surface thereof form locating members to enable another folded-down container to be simply and securely stacked on top thereof, with the load being transmitted through the corner posts 57.

As in the first embodiment, each panel comprises a peripheral metal frame of angle section frame members 73 to which are secured a solid timber ply panel 74 located on the inside of the angle metal frame members. Instead of timber ply, metal mesh or sheet metal may be used for the panels 74.

If required, simple slidable latching bolts 75 are used to releasably fasten together the upper corners of adjacent panels. In this embodiment, the hinge connection for the front panel 63 is formed by slidable hinge pins or bolts 76 which when disengaged, permits the panel 63 to be bodily removed when the container is erected and the lid 71 on. Normally, the lid 71 is removably supported on top of the upper edges of the side and end panels.

A brief consideration of the abovedescribed embodiments will indicate that the invention provides for a vastly improved storage pallet container which is of extremely simple design, which is versatile in its size adaption, which can be simply and quickly folded between its erected and collapsed conditions and which may be conveniently transported in the collapsed condition.

The claims defining the invention are as follows.

I claim:

1. An improved collapsible storage container comprising a substantially rectangular support base having an horizontal floor, a pair of opposed rectangular end panels, hinged about respective horizontal axes for folding inwardly relative to the base into a collapsed condition, and a pair of opposed rectangular side panels also hinged about respective horizontal axes for folding inwardly relative to the base into a collapsed condition, said horizontal axes being spaced at different distances from the floor, the panels being foldable inwardly approximately flat one on top of the other with adjacent panels in overlying relationship, each said panel including metal peripheral frame members, the improvements comprising:

a stub corner post of angle section fixed vertically at each of the four corners of the base, each said corner post having a height such that when said panels are in their collapsed condition, the upper ends of the corner posts project above the level of the uppermost folded down horizontal panel;

at least three upwardly projecting skirting walls on the base, each skirting wall extending between a respective pair of said stub corner posts, each skirting wall having its ends respectively engaging against corresponding inner surfaces of aligned flanges of the corner posts, said skirting walls having horizontal upper edge surfaces which are at different heights to one another, each said skirting wall supporting on its horizontal upper edge surface a respective one of said panels when said respective panel is in its erected condition, whereby loading forces applied to the panels are transmitted to the base via the skirting walls;

each said panel being pivotally supported between a respective pair of said corner posts by pivot means comprising essentially non-load bearing rigid pivot pins projecting laterally from opposite sides of the panel adjacent its lower end, each said projecting pin being rotatably received in a respective opening formed in a flange of a respective said corner post; and, said openings being dimensioned to prevent substantial vertical motion of said pins;

latching means for releasably latching together adjacent panels of the container at the upper corners thereof when said panels are in an erected condition, said latching means comprising an externally mounted, spring loaded, pivoted lever arm rockingly supported by one of said adjacent panels adjacent an upper corner thereof for limited rocking movement about an axis extending at right angles to the plane of said one panel, said rocking movement being between latch release and latch engaging positions, the lever arm being biased by said spring loading in the direction of its latch engaging position, the lever arm carrying at one end a latch pin extending in a direction parallel to the plane of said one panel, the latch pin being arranged to engage through a hole formed in the end of an external latch engaging bar, said bar being slidably mounted at the upper corner of the other of said adjacent panels for sliding to and fro movement between extended and retracted positions, said movement being in a direction at right angles to the axis of the latch pin, said bar projecting said end with said hole through aligned slotted openings in adjacent walls of the metal peripheral frame members of said adjacent panels, the pivotal rocking movement of the lever arm permitting the latch pin to be selectively engaged or disengaged with the latch engaging bar through said hole in said bar when the latter is in its extended position.

2. An improved collapsible storage container according to claim 1 wherein said support base comprises three said skirting walls which respectively support the pair of said panels and one said end panel, the other said end panel having its lower edge in contiguous relation with the floor of said base.

3. An improved collapsible storage container according to claim 1 wherein said container comprises a swingable lid panel hingedly supported by said one end panel adjacent its upper margin thereof and arranged to be supported on the upper edges of the four panels when in their erected position.

4. An improved collapsible storage container according to claim 3 wherein said container comprises a swingable lid panel hingedly supported by said one end panel adjacent its upper margin and arranged to be supported on the upper edges of the four panels when in their erected position.

5. An improved collapsible storage container according to claim 1 wherein said container comprises a removable lid panel removably supported on the upper edges of the panels when in their erected position.

6. An improved collapsible storage container according to claim 2 wherein said container comprises a removably lid panel removably supported on the upper edges of the panels when in their erected position.

7. An improved collapsible storage container according to claim 1 wherein said other end panel is formed in two halves which are hinged together by hinge means to enable each of the halves to swing about an horizontal axis relative to the other half, said other end panel as a whole being able to be swung or folded inwardly so as to lie flat on top of the support base or outwardly so as to extend away from the support base.

8. An improved collapsible storage container according to claim 2 wherein the other end panel is formed in two halves which are hinged together by hinge means to enable each of the halves to swing about an horizontal axis relative to the other half, said other end panel as a whole being able to be swung or folded inwardly so as to lie flat on top of the support base or outwardly so as to extend away from the support base.

9. An improved collapsible storage container according to claim 7 wherein the upper half of the other end panel is provided with a pair of slidable transverse pivot pins or bolts, one at each side thereof, arranged to releasably engage in pivot bolt engaging apertures in peripheral frame members of adjacent panels whereby with the pivot bolts so engaged, the lower half of the other end panel is able to be independently swung outwardly so as to provide an access opening into the bottom half of the interior of the container.

10. An improved collapsible storage container according to claim 8 wherein the upper half of the other end panel is provided with a pair of slidable transverse pivot pins or bolts, one at each side thereof, arranged to releasably engage in pivot bolt engaging apertures in peripheral frame members of adjacent panels whereby with the pivot bolts so engaged, the lower half of the other end panel is able to be independently swung outwardly so as to provide an access opening into the bottom half of the interior of the container.

11. An improved collapsible storage container according to claim 3 wherein said lid panel comprises a pair of panel portions hingedly connected to one another and arranged to permit the panel portions to lie in two positions, in one position one portion being on top of the other when the lid is in a folded partly opened condition and in the second position with the portions coplanar with one another, wherein the lid fully closes off the open upper end of the container.

12. An improved collapsible storage container according to claim 4 wherein said lid panel comprises a pair of panel portions hingedly connected to one another and arranged to permit the panel portions to lie in two positions, in one position one said portion being on top of the other when the lid is in a folded partly opened condition and in the second position with the portions coplanar with one another, wherein the lid fully closes off the open upper end of the container.

13. An improved collapsible storage container according to claim 5 wherein said lid panel has recessed portions at each of its four corners, each of the recessed portions being arranged to seatingly engage a corresponding corner portion of the support base of an adjacent container when stacked there on top.

14. An improved collapsible storage container according to claim 6 wherein said lid panel has recessed portions at each of its four corners, each of the recessed portions being arranged to seatingly engage a corresponding corner portion of the support base of an adjacent container when stacked there on top.

15. An improved collapsible storage container according to claim 5 wherein said removable lid is shaped and dimensioned so that, when the container is in its collapsed condition, the lid panel can be removably supported at each of its four corners on the upper ends of said corner posts.

16. An improved collapsible storage container according to claim 6 wherein said removable lid is shaped and dimensioned so that, when the container is in its collapsed condition, the lid panel can be removably supported at each of its four corners on the upper ends of said corner posts.

17. An improved collapsible storage container according to claim 1 wherein said latch pin, when in its engaged position, extends through said latch engaging bar hole and through an aligned hole formed in the wall of the peripheral frame member of said one panel.

18. An improved collapsible storage container comprising a substantially rectangular support base having a horizontal floor, a pair of opposed end panels hinged about respective horizontal axes for folding inwardly relative to the base into a collapsed condition, and a pair of opposed side panels hinged about respective horizontal axes for folding inwardly relative to the base into a collapsed condition, the arrangement being such that panels can be folded inwardly approximately flat one on top of the other with adjacent panels in overlying relationship, each said panel comprising metal peripheral frame members, and latching means for releasably latching together adjacent panels of the container at the upper corners thereof when in an erected condition, wherein said latching means comprises an externally mounted pivoted lever arm rockingly supported by one of said adjacent panels adjacent an upper corner thereof for limited rocking movement about an axis extending at right angles to the plane of said one panel between latch release and latch engaging positions, means for biasing the lever arm in the direction of its latch engaging position, the lever arm carrying at one end a latch pin extending at right angles to the lever arm and in the direction parallel to the plane of said one panel, an external latch engaging bar slidably mounted at the upper corner of the other of said adjacent panels for sliding to and fro movement between extended and retracted positions in a direction at right angles to the axis of the latch pin, said bar being provided with a hole adjacent an end thereof and through which said latch pin extends when the lever arm is in its latch engaging position, said bar when in its extended position projecting through aligned slotted openings in contiguous metal peripheral frame members of said adjacent panels, said lever arm when in its latch release position permitting the latch pin to be disengaged from the latch engaging bar to in turn allow the latter to be moved to its retracted position.

19. An improved collapsible storage container comprising a substantially rectangular support base having an horizontal floor, a pair of opposed rectangular end panels hinged about respective horizontal axes for folding inwardly relative to the base in a collapsed condition, and a pair of opposed rectangular side panels also hinged about respective horizontal axes for folding inwardly relative to the base into a collapsed condition, said horizontal axes being spaced at different distances from the base so that the panels can be folded inwardly approximately flat one on top of the other with adjacent panels in overlying relationship, each said panel comprising metal peripheral frame members, the improvements comprising:

a stub corner post of angle section fixed vertically at each of the four corners of the base, each said corner post having a height such that when said panels are in their collapsed condition, the upper ends of the corner posts project above the level of the uppermost folded down horizontal panel;

at least three upwardly projecting skirting walls on the base each extending between a respective pair of said stub corner posts, each skirting wall having its ends respectively engaging against corresponding inner surfaces of aligned flanges of the corner posts, said skirting walls having horizontal upper edge surfaces which are at different heights to one another, each said skirting wall supporting on its horizontal upper edge surface a respective one of said panels, when said respective panel is in its erected condition, whereby loading forces applied to the panels are transmitted to the base via the skirting walls;

each said panel being pivotally supported between a respective pair of said corner posts by pivot means comprising essentially non-load bearing rigid pivot pins projecting laterally from opposite sides of the panel adjacent its lower end, each said projecting pin being rotatably received in a respective opening formed in a flange of a respective said corner post, said openings being dimensioned to prevent substantial vertical motion of said pins.

* * * * *